US006264279B1

(12) United States Patent
Chow

(10) Patent No.: US 6,264,279 B1
(45) Date of Patent: Jul. 24, 2001

(54) THERAPEUTIC SLING SEAT

(76) Inventor: William W. Chow, 334 La Amatista Rd., Del Mar, CA (US) 92014

( * ) Notice: Subject to any disclaimer, the term of this patent is extended or adjusted under 35 U.S.C. 154(b) by 0 days.

(21) Appl. No.: 09/488,892

(22) Filed: Jan. 21, 2000

Related U.S. Application Data

(62) Division of application No. 08/965,268, filed on Nov. 6, 1997

(60) Provisional application No. 60/030,241, filed on Nov. 8, 1996.

(51) Int. Cl.[7] ..... A47C 7/20

(52) U.S. Cl. ..... 297/452.56; 297/452.22; 297/457.27

(58) Field of Search ..... 297/440.11, 457.55, 297/452.56, 457.5, 452.21, 452.22, 452.23, 452.24, 452.26, 452.27; 5/653, 654

(56) References Cited

U.S. PATENT DOCUMENTS

| | | | | |
|---|---|---|---|---|
| 2,865,436 | * | 12/1958 | Thorne | 297/440.11 |
| 3,024,068 | * | 3/1962 | Eames | 297/440.11 X |
| 4,558,904 | * | 12/1985 | Schultz | 297/440.11 |
| 5,318,348 | * | 6/1994 | Hess | 297/440.11 |
| 5,762,403 | * | 6/1998 | Robinson | 297/440.11 X |

* cited by examiner

*Primary Examiner*—Anthony D. Barfield
(74) *Attorney, Agent, or Firm*—Jerrold J. Litzinger

(57) ABSTRACT

A therapeutic sling seat comprising a flexible material which is non-uniform in stiffness providing maximum contact surface area with the body of a person seated in the seat by spreading the forces away from high pressure areas using multiaxis tension forces. The seat material in tension adapts to the contour of the posterior of the seated person. By controlling the pressures on the ischial tuberosities, physical problems such as ulcers can be avoided.

8 Claims, 9 Drawing Sheets

THERAPEUTIC SLING SEAT

CROSS-REFERENCE TO RELATED APPLICATIONS

This patent application is a divisional of co-pending application Ser. No. 08/965,268, filed Nov. 6, 1997 which application claims priority from provisional patent application Ser. No. 60/030,241, filed Nov. 8, 1996, which application is incorporated herein in its entirety by reference.

BACKGROUND OF THE INVENTION

1. Field of the Invention

The present invention relates generally to structures for supporting the human body while seated, and, in particular, to an improved cushioned sling seat structure which is designed to optimize the comfort and stability of the user.

2. Description of the Prior Art

There has been much research conducted over the years to attempt to improve the comfort of structures which serve to support the human body in a sitting position. It is well known that individuals who are required to sit for long periods are subject to discomfort, fatigue, pain, and various other afflictions associated with the lack of proper support of the torso of a person seated in an erect position over a sustained period of time. A common example of this problem occurs with individuals confined to wheelchairs. The lack of movement in this sitting position restricts blood flow, causing mechanical damage to body tissues and often leads to painful sores and ulcers.

Many attempts have been made to alleviate, if not prevent, these problems. These developments generally fall into several categories.

The most common types of cushions which have been used to address these problems are foam cushions. Foam cushions are popular, as they are lightweight, fairly durable, and inexpensive to manufacture. Foam pads with cut-out areas, convoluted surfaces, wedge-shaped slots and cored-out sections have been developed to minimize the adverse effects on the human body. Examples of these devices are taught in U.S. Pat. Nos. 4,042,987; 4,713,854; 3,111,689; 2,047,616; 3,337,884; and 3,222,694. There are several disadvantages, however, to the use of foams in cushions; foam generally has poor shear and tension properties, and also suffers from the inability to distribute loads or restoring forces evenly.

Another type of cushion which has been tried is a gel cushion. This type of cushion uses a viscous substance contained within some type of flexible structure capable of conforming with the body contours in contact with the cushion. While these cushions possess favorable tension and shear/friction properties, they are often heavy and bulky, and tend to deteriorate with heavy use. Examples of these cushions are taught in U.S. Pat. Nos. 3,858,379; 3,308,491; 3,663, 973; 3,689,948; 4,728, 551; 4,726,624; 5,336,708; 5,334,646; and 4,588,229.

Still another type of cushion which has been tried is a fluid-filled cushion. This type of cushion uses a fluid, such as gas or liquid, contained within a flexible envelope to allow the envelope to conform to the body contour. While gas-filled cushions are very light and inexpensive, the buoyancy is zero and the support of the body depends on a suitable hammock effect of the envelope plus the pressure of the air inside. Stability is generally greater with air filled cushions than that of liquid filled cushions because of increased tension in the envelope. Examples of the fluid filled cushions are shown in U.S. Pat. Nos. 2,823,394; 3,251,075; and 3,984,886.

Another type of cushion design which is available in the marketplace is the thixotropic, or "putty-filled" cushion. These cushions generally conform to the body in a suitable fashion as the material flows, can stiffen under fast loading to provide a solid and comfortable base for the body, and are designed to accurately control the flow of the material inside the cushion. However, this type of cushion tends to be fairly heavy, making it somewhat awkward to handle, can bottom out in some instances and tend to be relatively expensive compared to other cushions available. Examples of these cushions are taught in U.S. Pat. Nos. 4,726,624; 4,588,229; 4,728,551; and 5,018,790.

Finally, some cushion designs attempt to combine different features from the cushion types previously discussed to attempt to improve upon its performance. U.S. Pat. No. 2,819,712 combines a foam cushion with an air filled bladder; U.S. Pat. No. 5,524,971 uses a combination of fluid layers combined with foam layers; and U.S. Pat. No. 5,513, 899 uses an envelope filled with a combination of petrolatum and hollow glass spheres.

While there have been many attempts to provide a superior cushion to satisfy a diverse range of users, each design has particular deficiencies which make it difficult to gain universal acceptance. The one feature which is present in all of the aforementioned cushions is the fact that they all are subject to compression forces.

SUMMARY OF THE INVENTION

It is therefore an object of the present invention to provide a cushion which will provide maximum contact surface area along with uniform pressure on the body by spreading the forces away from high pressure areas using multiaxis tension forces.

It is also an object of the present invention to provide a seat which is inexpensive, lightweight, and durable, and offers stability.

It is a further object of the present invention to provide a cushion which can provide comfort and ventilation for a person seated for long periods of time without causing injury or fatigue.

These and other objects are accomplished in the present instance by a sling seat consisting of a thin and flexible material having non-uniform properties which allows the material in tension to adapt to the contour of the rear of the person seated. A person cannot sink into a compression type cushion more than the thickness of the cushion. In this tension type design, the ischial tuberosities of a person seated in the cushion are suspended, and will not "bottom out" in the cushion. By controlling the pressures on the ischial tuberosities and the coccyx of persons seated on a cushion manufactured according to the present invention, physical problems such as ulcers can be avoided in persons who must sit for long periods of time. Different embodiments of the invention are taught having features which enhance the desirable properties of the sling seat.

DESCRIPTION OF THE PREFERRED EMBODIMENTS

Figure 1:
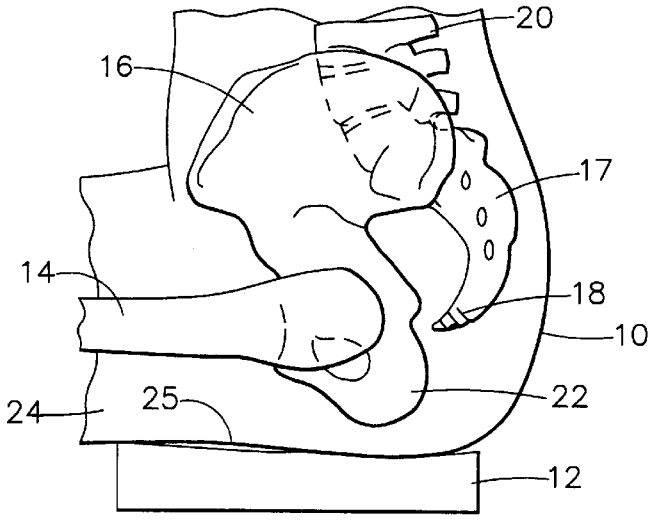
FIG. 1 is a side elevation view showing a partial skeleton of a person in a sitting position.
Figure 2:
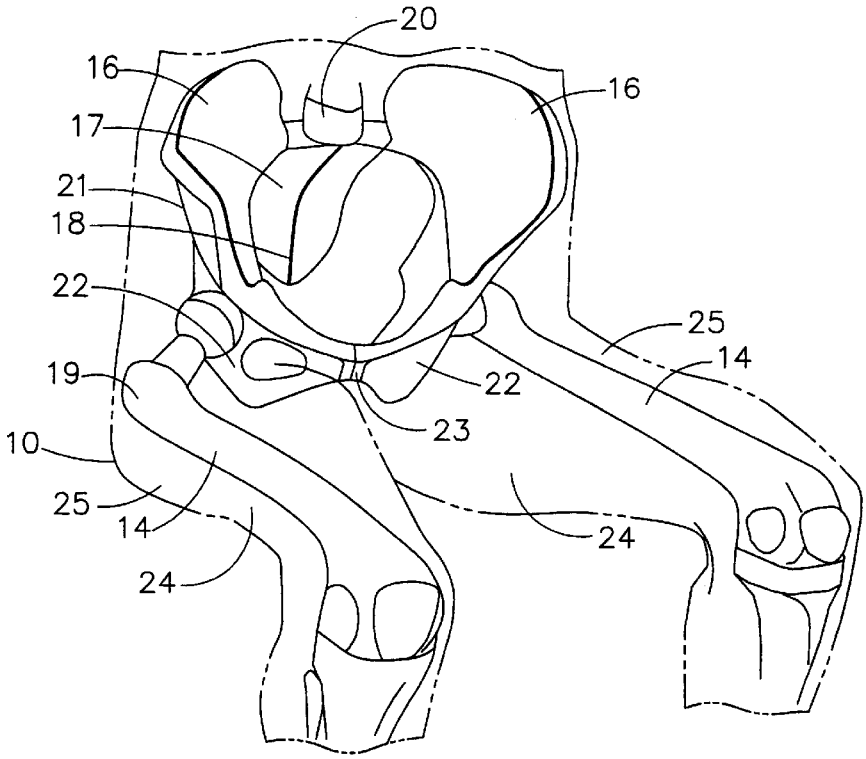
FIG. 2 is an isometric perspective view showing a partial skeleton of a person in a sitting position.

Referring now to FIGS. 1 and 2, there is depicted a section of the torso of a person in a sitting position, with the skeletal structure shown in detail. In this position, the gluteus maximus 10 is supported by a horizontal frame member 12 such that the femur or thigh bones 14 are supported in a substantially horizontal position. Also shown in FIGS. 1 and 2 are the pelvic or hip bones 16, the sacrum 17, the coccyx 18, the trochanter 19, the lumbar vertebrae 20 of the spine, the ilium 21, the ischial tuberosities 22, the pubic arch 23, the bicep muscles 24 and the proximal thigh regions 25.

It is well known that one of the major causes of discomfort experienced by a sitting person is pressure. The weight of the upper body is concentrated at bony prominences or projections of the body, such as the ischial tuberosities 22 and coccyx 18. Pressure exerted over a long period of time can often cause mechanical damage to the body tissue, causing ulcers and discomfort in the area of the gluteus maximus 10 and the bicep muscles 24 under the weight concentrated at the ischial tuberosities 22 and, to some extent, the femur 14, depending on how the body is situated in a particular chair. Usually, a sitting person unconsciously adjusts his body position when discomfort is felt. However, for those handicapped persons who cannot feel pain or who are unable to adjust their body positions, tissue damage can very easily result.

Figure 3:
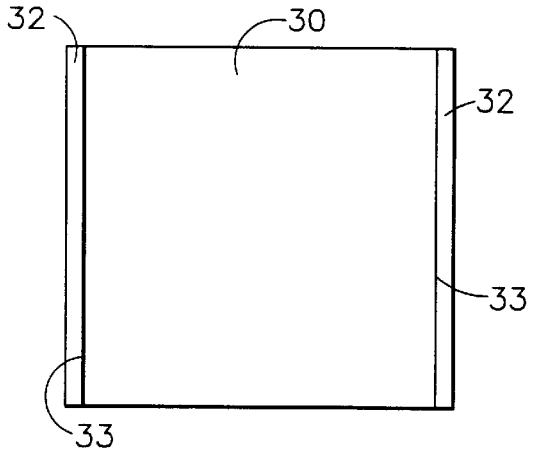
FIG. 3 is a top view of a traditional wheel chair sling seat.

FIG. 3 shows a basic sling seat construction. A flexible membrane 30, which may be fabric or any similar material, is suspended between a pair of supports 32 which are attached along opposing edges 33 of membrane 30. When a person sits upon that type of sling seat, membrane 30 deflects to form a concave surface between a catenary and the form of the body of the person sitting in the seat. The strength of membrane 30 is a function of the mechanical properties of its material and the method of its manufacture. In a traditional sling seat, the material for membrane 30 is usually chosen such that mechanical properties such as elasticity and friction are uniform in any location and direction on the material. In the sling seat of the present invention, however, the material of membrane 30 is selected such that a large surface contact area is obtainable by use of a thin and stretchable material which is non-uniform in stiffness. Several suitable materials for use in the present invention are LYCRA and POLARTEC. These fabrics provide a strong, yet very flexible, membrane by which the body weight of a person is entirely supported by multi-axis tension forces in the material, and allow the seat to essentially conform to the shape of the body and provide maximum surface contact area. Thus, the area of the seat located under the ischial tuberosities 22, where the pressure on the tissue is quite high in a traditional sling seat, conforms to the shape of the gluteus maximus 10, thereby minimizing the pressure.

Figure 4:
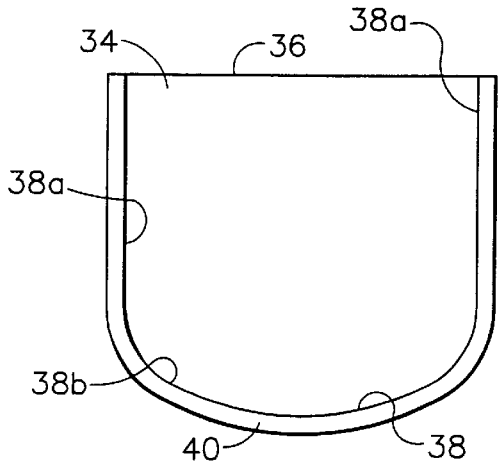
FIG. 4 is a top view of an alternative embodiment of a traditional sling seat having improved support of the back edge.

FIG. 4 shows an alternative embodiment of the basic sling seat construction of the present invention. The sling seat consists of a flexible membrane 34 having a forward edge 36 and a peripheral edge 38. Edge 38 consists of a pair of substantially parallel sides 38a connected by a curved side 38*b*. Edges 38*a* on each side are connected by a rear edge 40. Membrane 34, which is constructed of a stretchable material non-uniform in stiffness such as LYCRA, is suspended along its peripheral edge 38. In this embodiment, membrane 34 more completely conforms to the shape of the body of the person sitting in the seat than membrane 30 of the previous embodiment, as membrane 34 is supported on all sides except front edge 36.

Figure 5:
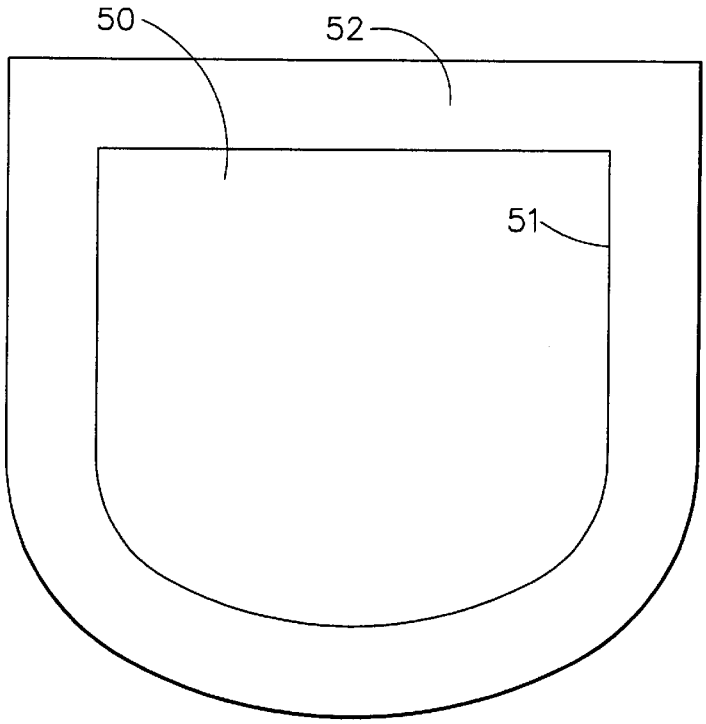
FIG. 5 is a top view of an alternative embodiment of the seat shown in FIG. 4.

FIG. 5 shows an alternative embodiment of a sling seat manufactured using the principles of the seat shown in FIG. 4. Membrane 50, having an outer edge 51, is constructed from the same material and in the same basic shape as membrane 34. However, a peripheral membrane 52 is attached along the outer edge 51 of membrane 50. Membranes 50 and 52 can be constructed from the same type of flexible material having non-uniform characteristics, or it may be desirable for membrane 50 to exhibit a different rigidity characteristic than the peripheral membrane 52, so that the weight bearing zone of the seat, specifically the area under the ischial tuberosities, will conform more closely to the body and more evenly distribute the pressure. In this embodiment, the inner membrane 50 can be selected to more closely fit the desired characteristics of elasticity for different persons, while maintaining a different peripheral membrane 52 with physical characteristics most ideally suited for attachment to a support frame.

Figure 6:
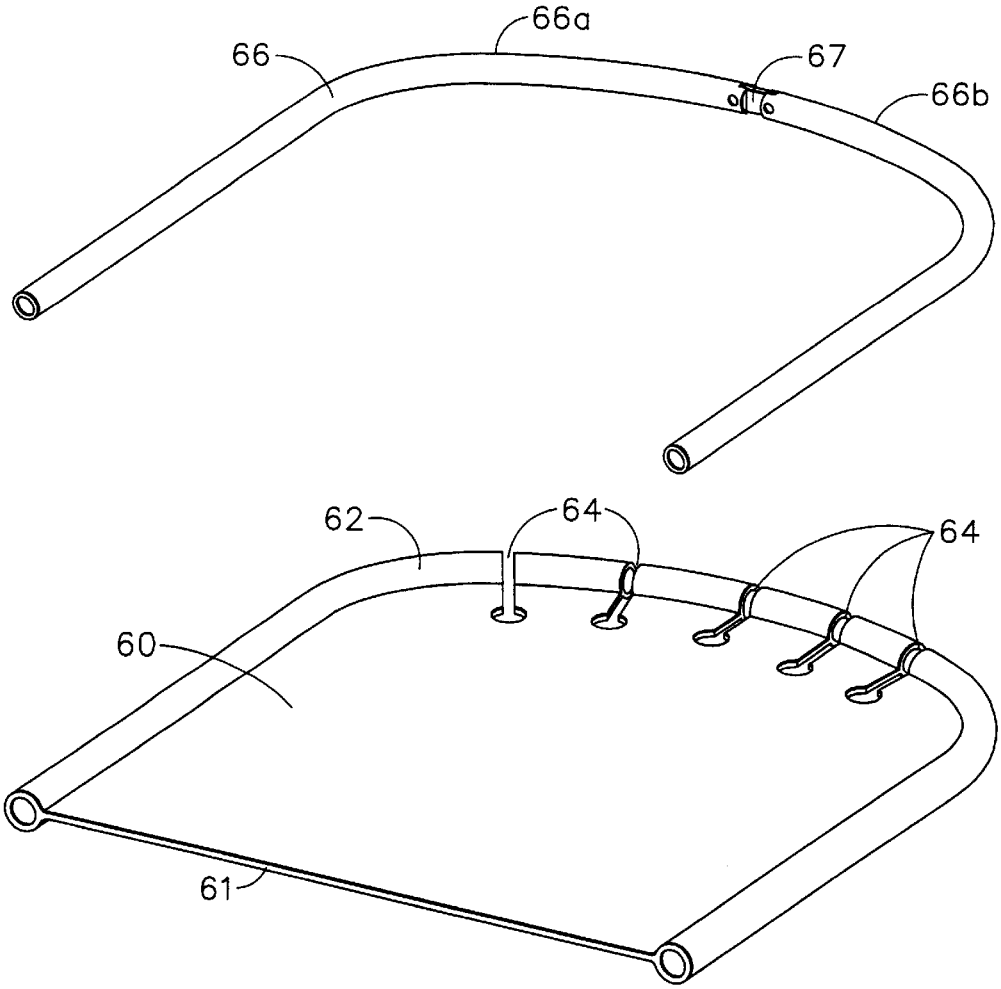
FIG. 6 is a perspective view of another alternative embodiment of a seat according to the present invention.

FIG. 6 shows a variable thickness molded rubber sling seat which is constructed according to the principles of the present invention. In this embodiment, cushion 60 consists of a one piece molded rubber form having a front edge 61 and a U-shaped channel 62 positioned about its remaining periphery. A series of notches 64 are present along the rear of the periphery to enhance the flexibility of cushion 60. A cylindrical frame 66 formed from a pair of tubular sections 66*a* and 66*b* coupled together at a hinge 67 is sized to fit within channel 62 of cushion 60. Hinge 67 allows frame 66 to be folded to a compact form. When cushion 60 is suspended from frame 66 in a suitable structure such as a wheelchair, cushion 60 deflects to conform to the shape of the body seated on it, as the rubber flexes in tension, accommodating the curvature of the body and minimizing the pressure by distributing the resultant forces evenly.

Figure 7:
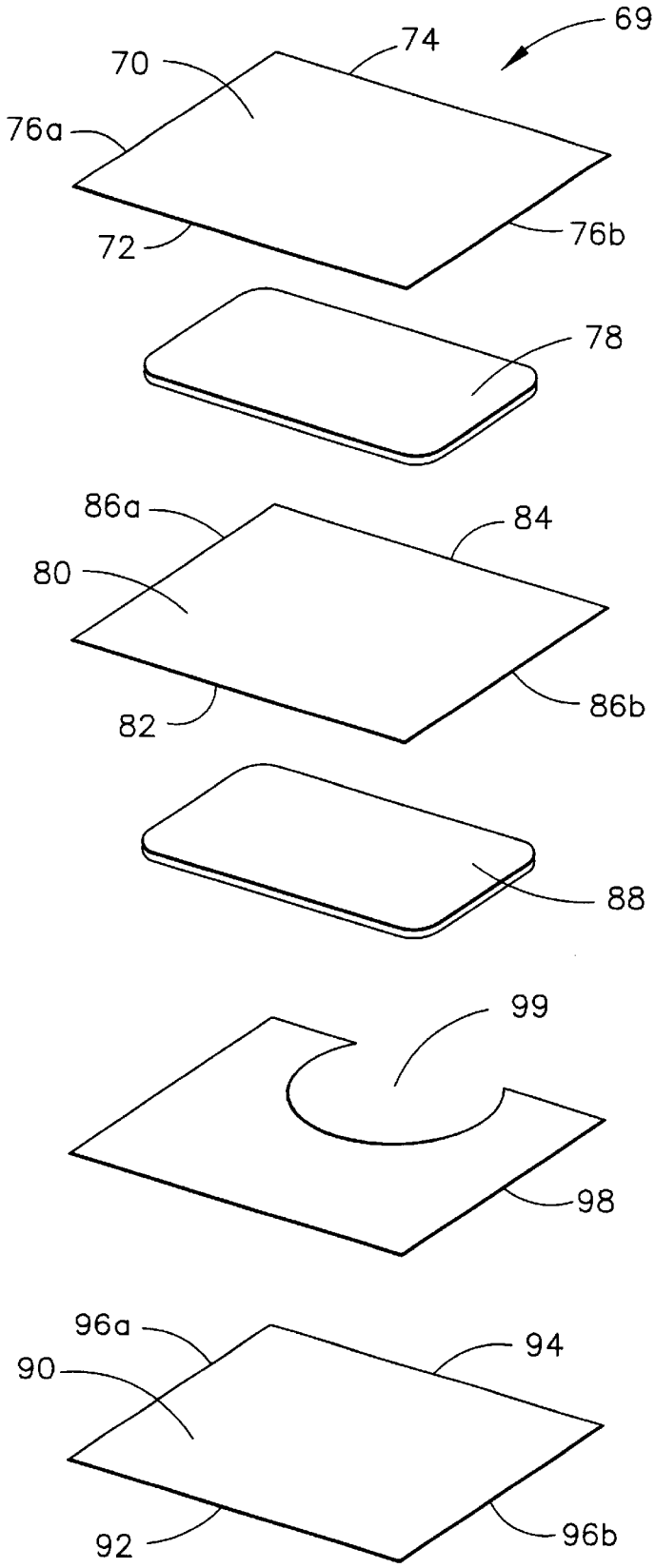
FIG. 7 is a perspective view of a multi-layer design with stiffener, described by the technology of the present invention.

Referring now to FIG. 7, another alternative embodiment of a sling seat 69 similar to that of FIG. 3 is shown. A flexible membrane 70 has a forward edge 72 and rearward edge 74 and a pair of essentially parallel side edges 76*a* & 76*b*. Membrane 70 is constructed of a flexible fabric which is non-uniform in stiffness, such as LYCRA or POLARTEC. A pad 78, which is preferably constructed of a thin layer of foam, is positioned adjacent the bottom side of membrane 70. Foam pad 78 can be manufactured using a range of thickness variations, along with various hole patterns, to further control the areas of contact with the seated person. A second membrane 80, having a front edge 82 and rear edge 84 and a pair of essentially parallel side edges 86 and 86*b*, is positioned beneath pad 78. Membrane 80 is also constructed from a flexible fabric which is non-uniform in stiffness. Beneath membrane 80 is a second pad 88 constructed from a thin layer of foam. Finally, a third flexible membrane 90 having a front edge 92, and a rear edge 94, and a pair of essentially parallel side edges 96*a* and 96*b* is positioned beneath pad 88. The sling seat is formed by attaching side edges 76*a*, 86*a*, and 96*a* together by conventional means, such as sewing, and also side edges 76*b*, 86*b*, and 96*b* to form sling seat 69. Seat 69 is then suspended between a pair of supports by attaching edges formed at 76*a*, 86*a*, 96*a* and 76*b*, 86*b*, 96*b*. By varying the physical properties of each of the layers, a variety of seats with desired characteristics can be obtained. In this arrangement, membranes 70, 80, and 90 are always in tension, while the pads 78 and 88 held between the membranes are in compression.

This seat forms a concave surface which surrounds the contour of the person seated upon it, as the membrane and foam layers are pliable. However, sometimes it is desirable to limit the deflection of the seat for support purposes. This is accomplished by the use of a stiffener layer 98 which may be sandwiched between the layers. Stiffener 98, which may be constructed from a polycarbonate plastic sheet such as LEXAN having a thickness of approximately 0.125 inches, contains a cutout section 99 which comfortably accommodates the ischial tuberosities and sacrum of the body, while stiffener 98 provides rigid support beneath the femurs to assist the person when rising from the seat. Stiffener 98 also strengthens the seat for durability and handling.

Figure 8:
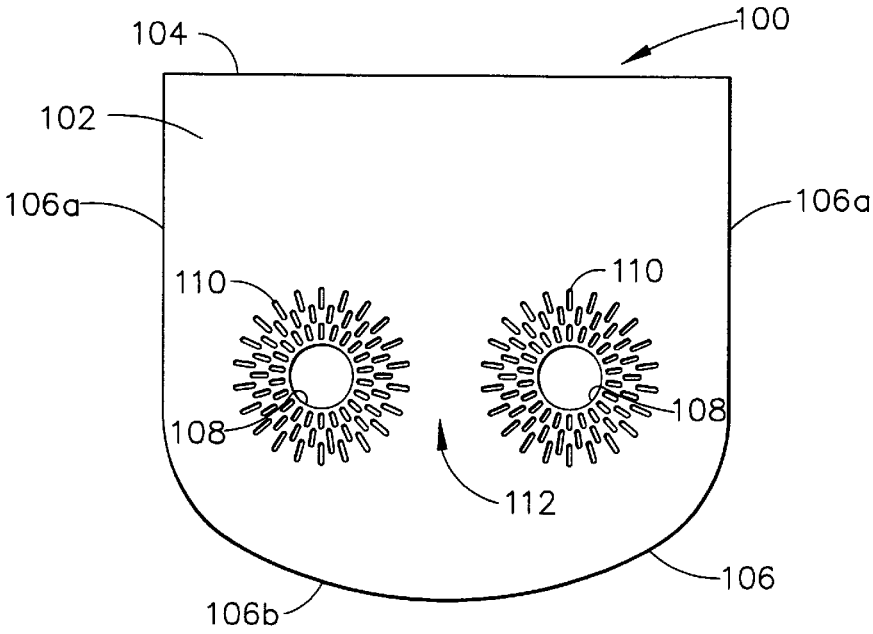
FIG. 8 is a top view of a molded sheet rubber design according the present invention.

Referring now to FIG. 8, another alternative embodiment of a sling seat 100 similar to that of FIG. 4 is shown. A flexible membrane 102 has a forward edge 104 and a peripheral edge 106. Edge 106 consists of a pair of essentially parallel sides 106*a* connected by a curved side 106*b*. In this embodiment, membrane 102 is constructed of a suitable sheet rubber, such as neoprene, which is non-uniform in stiffness. Membrane 102 is suspended along its peripheral edge 106 to form sling seat 100.

Within the interior of membrane 102, a pair of apertures 108 are positioned to approximate the positions of the ischial tuberosities of a person sitting in seat 100. Extending radially from each of apertures 108 is found a series of small oval perforations 110. The area 112 of membrane 102, between apertures 108 serves to provide support for the pubic arch of the person seated in this seat, as the pubic arch is a sensitive part of the body and pressure on it must be carefully controlled by sufficient deflection downwardly to avoid distress. The essence of the design of the present invention is to achieve gentle contact without pressing with excessive force against the sensitive pubic arch.

In the embodiment shown, perforations 110 are arranged in a series of concentric circles extending outwardly from apertures 108. Within each circle, perforations 110 are arranged in a sunburst pattern. Perforations 110 are staggered from one circle to another. The sunburst pattern increases flexibility in the circumferential direction, thus enhancing radial expansion of membrane 102. Apertures 108 and perforations 110 allow membrane 102 to more comfortably accommodate the ischial tuberosities by more efficiently distributing the body weight. Different patterns of perforations 110 can be employed to accomplish this distribution.

Figure 9:
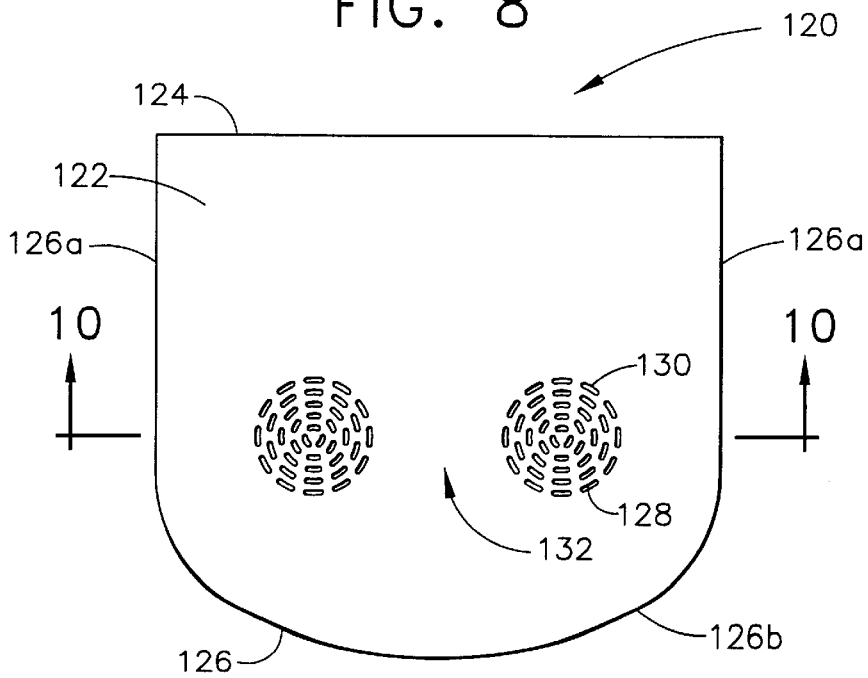
FIG. 9 is a top view of an alternative embodiment of the seat shown in FIG. 8.
Figure 10:
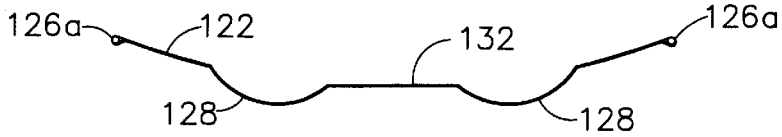
FIG. 10 is a cross-sectional view taken along lines 10—10 of FIG. 9.

FIG. 9 shows an alternative embodiment of the seat shown in FIG. 8. Seat 120 consists of a flexible membrane 122 having a front edge 124 and a peripheral edge 126. Edge 126 consists of a pair of essentially parallel sides 126*a* connected by a curved side 126*b*. Membrane 122, which is constructed from a suitable sheet rubber such as neoprene, contains a pair of recessed sections 128 which have been molded into membrane 122 (see FIG. 10). The area 132 of membrane 122 between sections 128 acts as a support for the pubic arch.

Recessed sections 128 each contain a series of perforations 130 which are arranged in a series of concentric circles. Sections 128, like apertures 108 shown in FIG. 8, allow for the accommodation of the ischial tuberosities of a person seated in seat 120. The concentric circular pattern can also be used in the embodiment shown in FIG. 8, as it increases the vertical drop of membrane 102, thus allowing membrane 102 to form cups to more comfortably support the ischial tuberosities.

Figure 11:
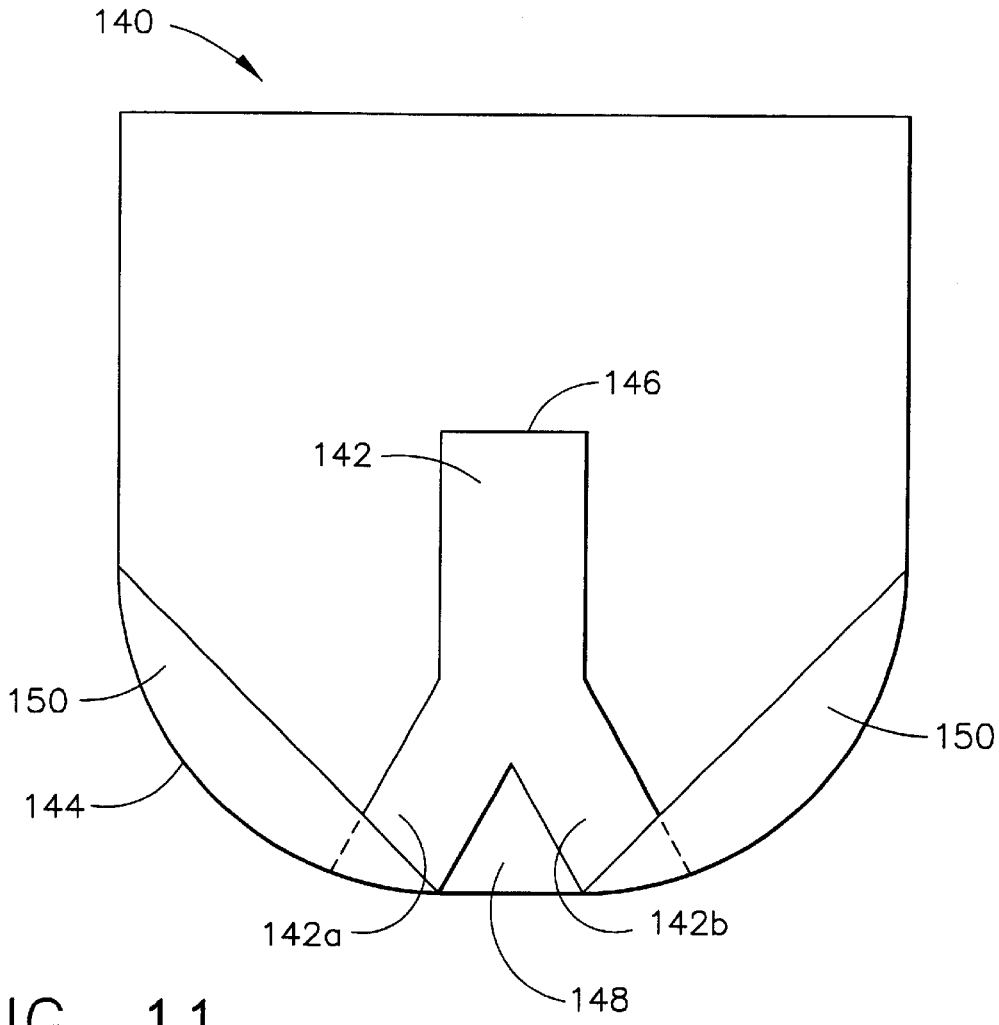
FIG. 11 is a top view of another embodiment of a seat according to the present invention having additional pubic arch and ilium support.

FIG. 11 shows another alternative embodiment of a sling seat manufactured according to the present invention. Seat 140 is similar to the embodiments shown in FIGS. 4 and 5. However, seat 140 includes a membrane 142 located beneath the pubic arch of the seated person for the purpose of creating pressures and to also provide vertical lift to support the person's weight. Membrane 142 is supported along the periphery 144 at the rear of seat 140 and is affixed at an area 146 in the central region of seat 140. Preferably, membrane 142 is Y-shaped and oriented such that the coccyx and ilium of the seated person is located in an area 148 between arms 142*a* and 142*b* of membrane 142. Also located on seat 140 are a pair of wedges 150. Wedges 150, which are constructed of a stiff material, are located along periphery 144 on either side of membrane 142 and are constructed such that they are angled at preferably a 45° angle from periphery 144 toward the central region of seat 140. Wedges 150 are used to properly position the hip bones of the seated person forward and also to keep the sacrum away from the back edge of seat 140, aiding in positioning the body in the seat for optimum comfort. Arms 142*a* and 142*b* are anchored at the inner central edges of wedges 150.

Figure 12:
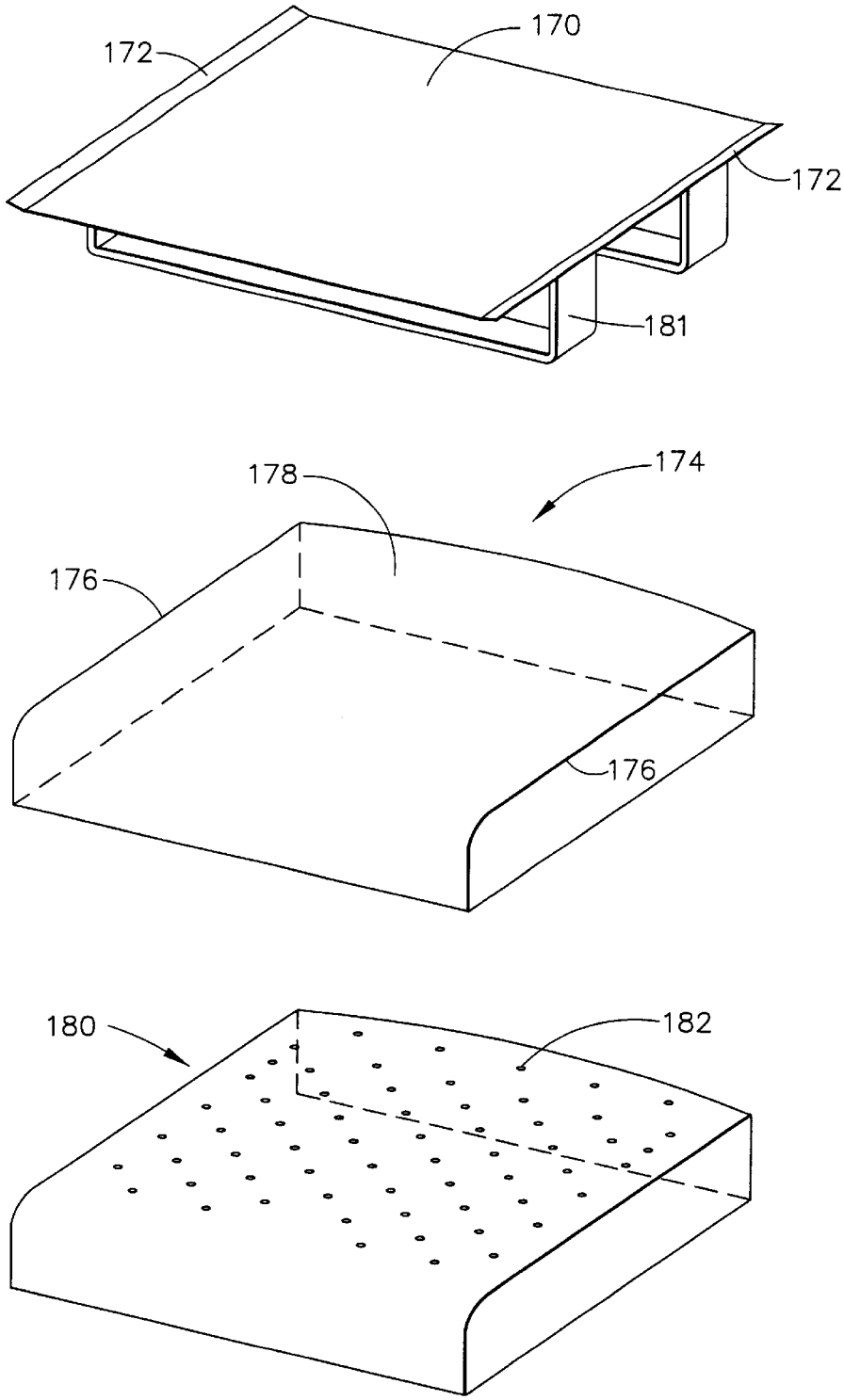
FIG. 12 is a perspective view of another embodiment of a seat according to the present invention.

FIG. 12 shows an embodiment of the seat of FIG. 3 in which no frame is used to support the sling seat. Membrane 170 is preferably constructed from a flat sheet of a flexible fabric of a non-uniform stiffness, as is disclosed in FIG. 3, having a pair of parallel edges 172. Edges 172 are attached to a cover 174. Cover 174 is preferably a canvas bag made from a fabric such as CORDURA. Edges 172 are sewn along upper edges 176 of cover 174 such that membrane 170 is stretched across the top surface 178 of cover 174. Cover 174 is then stretched over a core 180. To ensure proper tensioning of membrane 170, elastic straps 181 are used to wrap under core 180. Core 180 is preferably composed of a layer of a semi-rigid composite foam such as L-380XLPE foam. Core 180 may also contain a series of perforations 182 to control its stiffness.

This combination forms an "invisible" frame which helps to avoid injury if a person is not properly fitted or seated in the seat. The bony points of the body such as the coccyx, trochanter, and sacrum may come into contact with a rigid frame, thus causing possible severe injury. The seat taught in FIG. 12 can avoid this possibility, which can be a serious problem with wheelchair patients.

Figure 13:
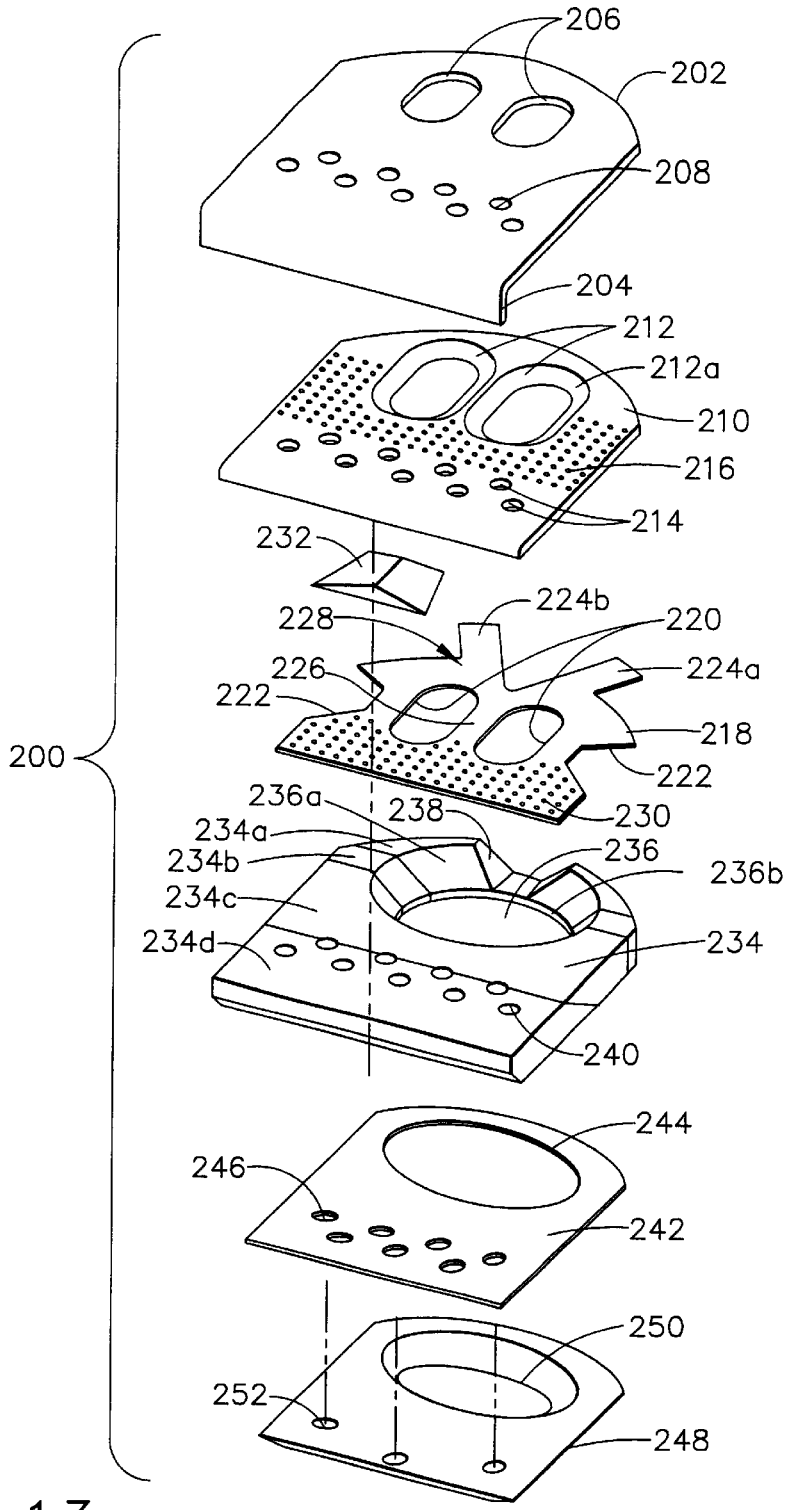
FIG. 13 is an exploded view of the components of an invisible frame design according to the present invention.

FIG. 13 shows an embodiment of a seat manufactured according to the principles of the present invention. Seat 200 consists of a top layer 202 having a curved front end 204 along with a pair of apertures 206 which allow for comfortable accommodation of the ischial tuberosities of the user. In addition, a plurality of circular apertures 208 may be located along the central area of layer 202 between apertures 206 and front end 204 to provide ventilation. Layer 202 is preferably constructed from a soft foam, such as an open cell polyurethane.

Adjacent layer 202 in seat 200 is a layer 210. Layer 210, which is essentially planar, contains a pair of apertures 212 which correspond to apertures 206 in layer 202. Surfaces 212*a* of apertures 212 may be tapered inwardly, as can be seen in FIG. 13, to assist in proper location of the ischial tuberosities. Layer 210, which is preferably constructed from a semi-rigid foam such as VOLTEK L200 cross-linked polyethylene, also contains a series of apertures 214, similar to apertures 208 in layer 202, which assist in providing ventilation for seat 200. Finally, layer 210 also contains a plurality of small perforations 216 which provide stiffness control for layer 210 at the proximal thigh and trochanter areas.

A sheet rubber layer 218 is positioned adjacent layer 210 away from top layer 202 within seat 200. Layer 218, which is preferably neoprene rubber, contains a plurality of apertures 220 corresponding to apertures 212 and 206 of layers 210 and 202, respectively. Layer 218 also contains a cutout section 222 located along each outer edge to accommodate the trochanters of the user of seat 200. In addition, layer 218 contains a pair of extensions 224*a* and 224*b*, which, together with a support member 226, which separates apertures 220, form a Y-shaped support, which is generally indicated at 228. Support 228 provides tension support and enhances weight distribution for the user of seat 200 by properly positioning the coccyx and ilium. Layer 218 also contains a plurality of perforations 230 which provide stiffness reduction at the proximal thigh.

Situated below layer 210 is a median divider device 232, preferably constructed from VOLTEK L-200, which provides stability for the knees of the user of seat 200 by correctly positioning the legs of the user. Device 232 is preferably adhesively affixed to the underside of layer 210 centered along its front edge.

A foam cushion 234 is positioned adjacent sheet layer 218 on the side opposite layer 210. Foam cushion 234 is preferably a composite device, constructed from different foam materials having different physical properties which are selected to match the vertical deflection of seat 200 required for the different body parts of the user. In the embodiment shown in FIG. 13, cushion 234 is composed of separate foam sections 234*a*, 234*b*, 234*c* and 234*d*. Section 234*a* supports the ilium, section 234*b* supports the mid-back, section 234*c* supports the proximal thigh and trochanter regions, and section 234*d* supports the legs of the user. Cushion 234 contains an elliptical cutout opening on region 236 which preferably contains a surface 236*a* which tapers outwardly from a lower surface 236*b* in the direction of layer 218.

Cushion 234 also contains a recessed area 238 along its rear edge which comfortably accommodates the coccyx of the user of seat 200. Finally, cushion 234 contains a plurality of apertures 240 similar to apertures 208, 214 of layers 202, 210 respectively which help to provide ventilation for seat 200.

Adjacent cushion 234 is a stiffener plate 242. Plate 242 provides support which allows seat 200 to act as a sling seat when it is placed on an existing chair or support such as a wheelchair. Plate 242, which is constructed from a relatively thin rigid material such as plywood, a hard plastic, or a high impact polystyrene sheet, contains an elliptical opening 244 comparable to cutout region 236 in foam cushion 234. Plate 242 insures that cushion 234 stays flat and also supports the back section under the coccyx of the user of seat 200. Plate 242 also includes a series of apertures 246 which provide ventilation for seat 200.

In some instances where seat 200 will not fit properly into a wheelchair, a booster device 248 can often be employed to raise the hips of the user above the side rails of the wheelchair. Device 248, which is preferably constructed from a rigid material such as VOLTEK L200, contains an elliptical opening 250 which is comparable to openings 244, 236 in plate 242 and cushion 234 respectively, which tapers in the same manner as cutout region 236 in cushion 234.

Finally, booster device 248 may contain a plurality of raised protrusions 252 which fit within apertures 246 of plate 242 to ensure accurate positioning of booster device 248 in relation to seat 200.

Figure 14A:
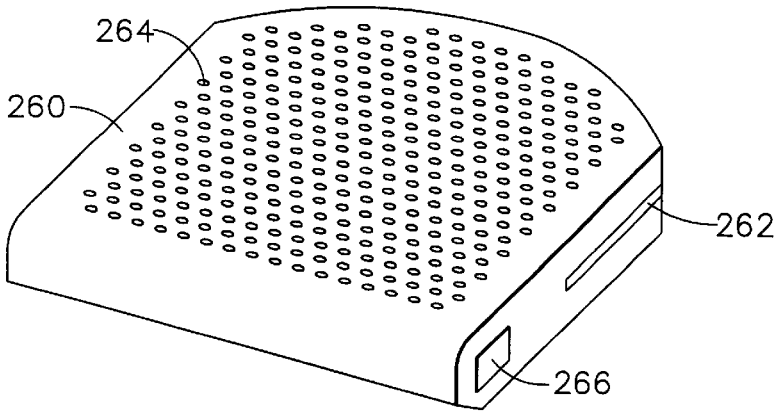
FIGS. 14*a* and *b* each show a perspective view of a cushion covering for use with the cushion taught in FIG. 13.

FIG. 14*a* and *b* illustrate a removable cover system for use with the seat of FIG. 13. Referring now to FIG. 14*a*, a removable protective cushion bag 260 is shown. Bag 260, which is preferably constructed from a water resistant and low-friction material such as CORDURA, contains a zipper 262 which is affixed along its rear end such that seat 200 can be easily inserted into bag 260 to protect it from any debris or liquids which may tend to soil seat 200 if unprotected. Bag 260 also contains a series of apertures 264 to allow for air circulation and ventilation. Affixed on the side of bag 260 is an indicator 266, which when aligned with a mark on the wheelchair, enables seat 200 to be placed in exactly the same position on the wheelchair each time after it has been removed.

Figure 14B:
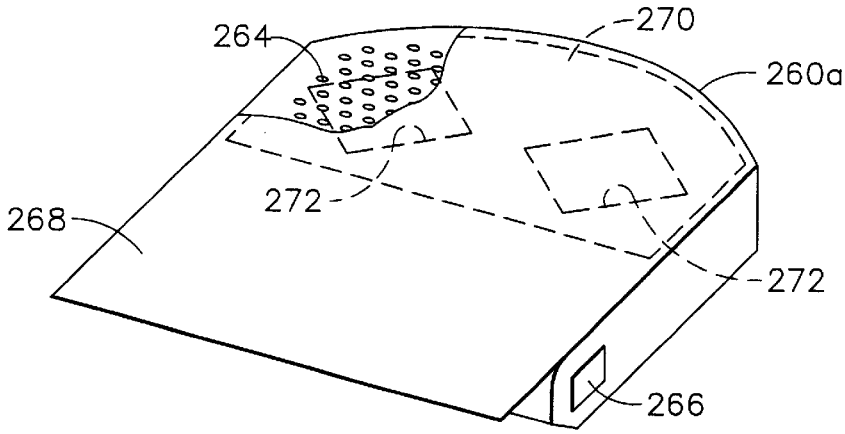

FIG. 14*b* shows a variation of cushion bag 260, designated as a slip cover 260*a*, which can be used with the seat of the present invention. Cover 260*a* has a front flap 268 which is folded over seat 200 after it is inserted into cover 260*a* and fastened to the underside using a removable attachment means such as VELCRO (not shown). Cover 260*a* also contains a rubber sheet 270 attached to the underside of the top of cover 260*a* for added strength and durability. Sheet 270, which is preferably manufactured from neoprene, may also contain apertures 272 to accommodate the ischial tuberosities or any irregular bony points of the user of seat 200.

Figure 15:
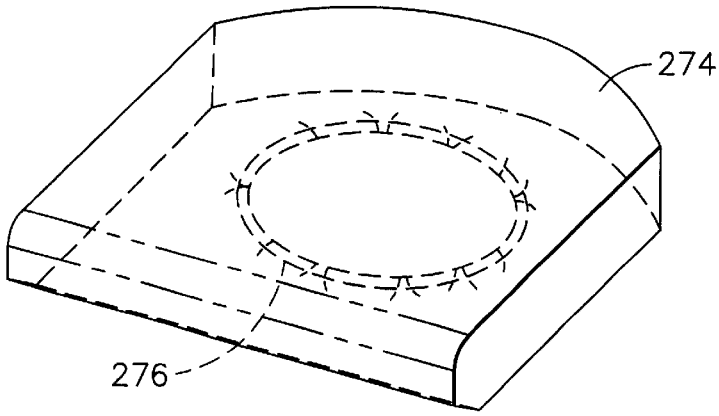
FIG. 15 is a perspective view of a cosmetic cover for use with the cushion taught in FIG. 13.

FIG. 15 shows a separate cosmetic cover 274 which may be used as an additional cover over bag 260 or cover 260*a* as further protection from the elements of the environment of use of seat 200. Cover 274, which preferably manufactured from a strong, flexible, washable fabric such as LYCRA or POLARTEC, is stretched over seat 200 and bag 260 or cover 260*a* and is held in place by an elastic cord 276, which holds cover 274 tightly in place about seat 200.

While this invention has been shown and described in terms of several preferred embodiments thereof, it will be understood that this invention is not limited to any particular embodiment and that many changes and modifications may be made without departing from the true scope and spirit of the invention as defined in the appended claims.

What is claimed is:

1. A sling seat, comprising:

a plurality of flexible layers of material of non-uniform stiffness, with each layer having a top side, a bottom side, a front edge, a rear edge, and a pair of generally parallel side edges, with each of said side edges of said layers fastened together to form a pair of generally parallel side seams;

at least one flexible pad located between each of said flexible layers of material;

a stiffener layer located between said flexible layers containing a cutout section for accomodating the ischial tuberosities of a person seated on said seat;

and means for seperately supporting each side seam to form a sling seat.

2. The seat of claim 1, wherein said flexible layers of material are held in tension.

3. The seat of claim 1, wherein said flexible pads are held in compression.

4. The seat of claim 1, wherein said flexible pads are constructed from foam rubber.

5. The seat of claim 1, wherein said flexible pads are constructed from sheet rubber which contains a plurality of protrusions for spacing said flexible layers apart.

6. The seat of claim 2, wherein the tension forces within said material are multi-directional.

7. The assembly of claim 1, wherein said stiffener layer is constructed from a polycarbonate plastic.

8. The seat of claim 1, wherein of at least one said flexible layers is constructed from LYCRA.

* * * * *